United States Patent [19]

Hamatani

[11] Patent Number: 4,643,409

[45] Date of Patent: Feb. 17, 1987

[54] ENGINE PUSH ROD HOLDER

[76] Inventor: George Hamatani, Rte. 1, Box 400, Clarksburg, Calif. 95612

[21] Appl. No.: 771,535

[22] Filed: Aug. 30, 1985

[51] Int. Cl.[4] ..... B25B 1/20

[52] U.S. Cl. ..... 269/43; 269/254 R; 269/152; 294/81.28; 294/87.1

[58] Field of Search ..... 24/336, 335, 537; 294/87.28, 87.1, 159; 211/60.1, 89, 66; 269/43, 269/254 R, 152

[56] References Cited

U.S. PATENT DOCUMENTS 2,080,947 5/1937 Ligeour ..... 294/87.1

3,946,877 3/1976 Galicia ..... 211/89

*Primary Examiner*—Robert C. Watson

*Attorney, Agent, or Firm*—Lothrop & West

[57] ABSTRACT

An engine push rod holder of one piece of partially resilient material has a relatively thin, flat head from one edge or which a plurality of pairs of fingers extend in one direction. The fingers of each of the pairs have arcuate ends facing each other in the direction of the fingers and are deformable to snap around and closely engage a push rod.

4 Claims, 9 Drawing Figures

ENGINE PUSH ROD HOLDER

CROSS REFERENCE TO RELATED APPLICATIONS

The applicant herein is the applicant in a United States design patent application Ser. No. 599,316, filed Apr. 12, 1984.

BRIEF SUMMARY OF THE INVENTION

An engine push rod holder, for use in overhauling an engine having a plurality of push rods grouped substantially in a longitudinal plane, has a body of partially resilient material formed with a relatively thin, transversely flat, longitudinally extending head and a plurality of pairs of spaced apart fingers extending about parallel to each other from one edge of the head portion, the fingers of each pair at their ends opposite the head ending in transversely closely spaced, facing arcuate portions adapted to flex around and engage a respective one of said plurality of push rods.

DETAILED DESCRIPTION

Figure 2:
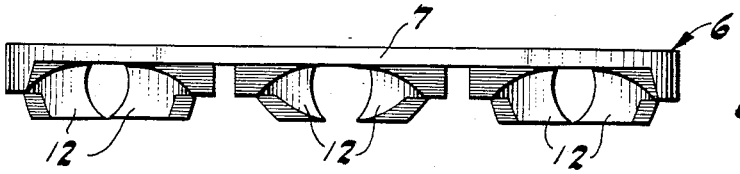
FIG. 2 is a top plan view of the holder of FIG. 1.
Figure 1:
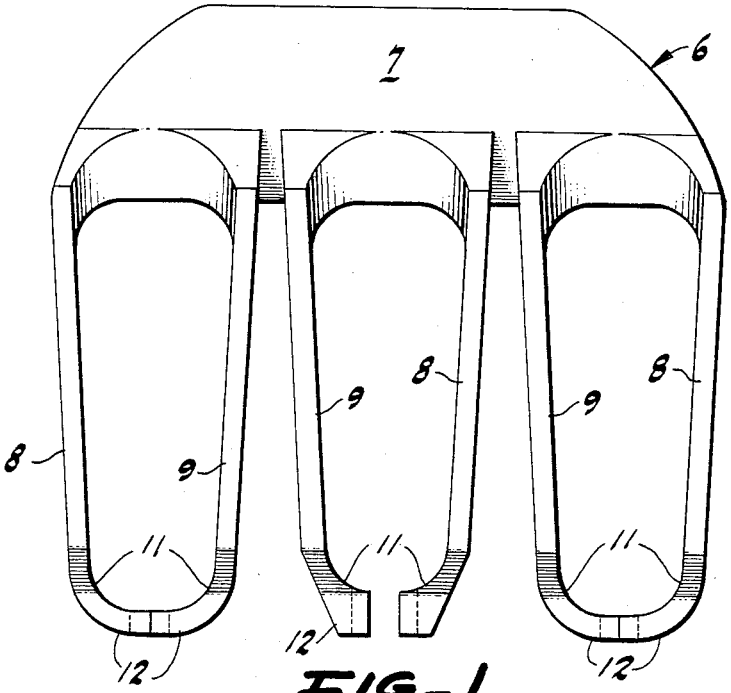
FIG. 1 is a front elevation of the rod holder of the invention.
Figure 4:
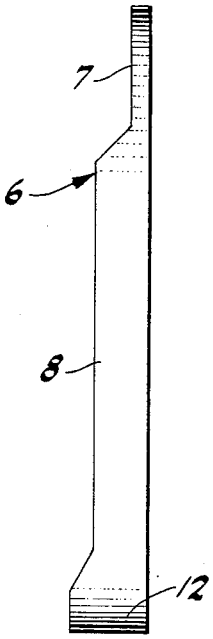
FIG. 4 is a side elevation of the holder of FIG. 1.
Figure 3:
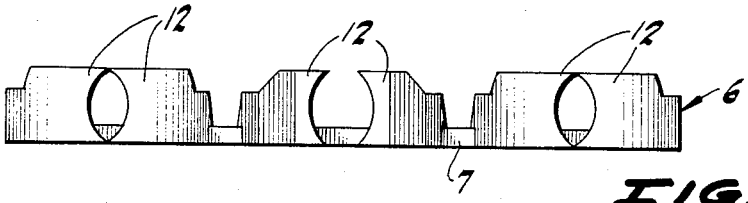
FIG. 3 is a bottom plan view of the holder of FIG. 1.
Figure 5:
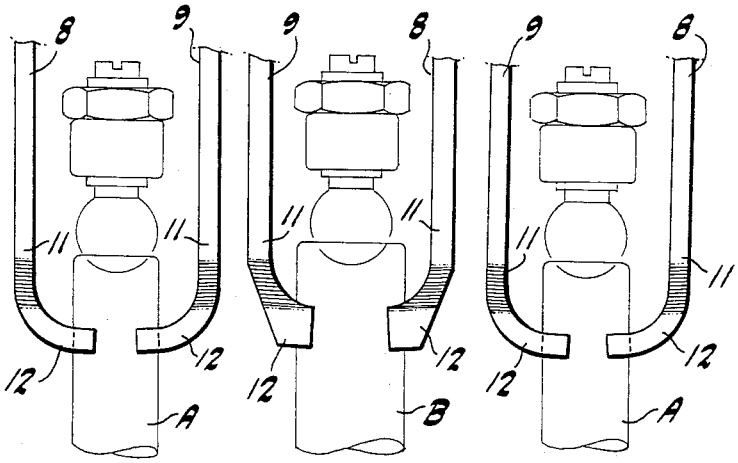
FIG. 5 is a partial front elevation illustrating the position of the fingers when gripping the push rods.
Figure 6:
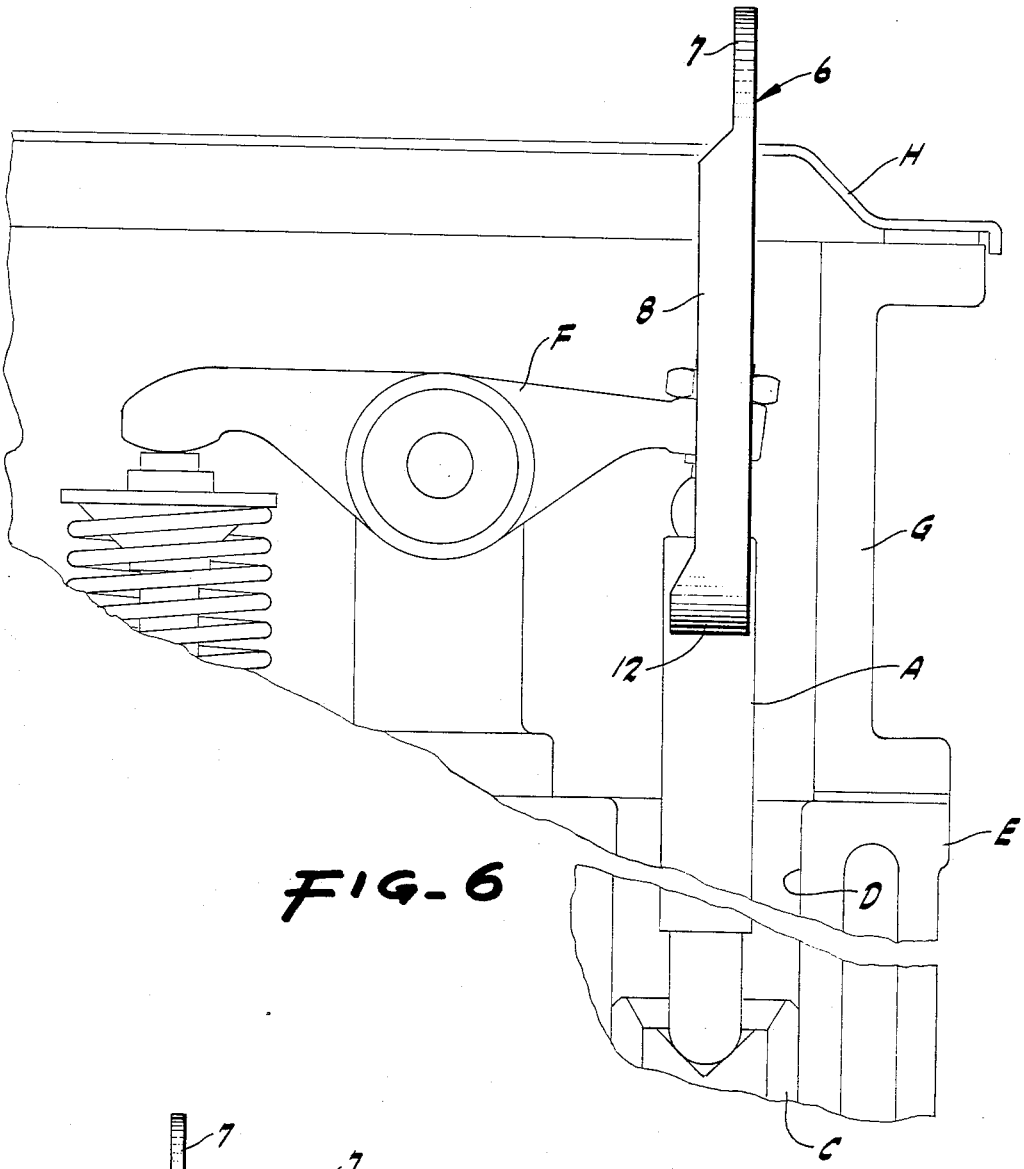
FIG. 6 is a schematic view, largely in transverse cross-section of a portion of an exemplary engine showing the holder of the invention in use therewith.

In many internal combustion engines it is customary to have for each cylinder poppet inlet and exhaust valves and in some engines also to have for each cylinder a reciprocating fuel injector, each of the valves and the injector being individually actuated by a camshaft acting on valve and injector rockers through individual push rods. It is also usual to have the various valve, injector and actuating parts in separable parts of the engine such as a cylinder block, a detachable cylinder head, sometimes a separate rocker head and a removable valve and rocker case cover. The push rods usually extend into or through several of the separable parts. When such parts are separated for an engine overhaul, the normally well supported and positioned push rods are deprived of some support and may well get out of position by gravity, by accidental contact or other means. Then, when the engine parts are reassembled, there may occur difficulties in realigning, or positioning, the push rods with their valves and injectors. In fact, the attempt to realign and interfit the parts by hand during reassembly may be quite dangerous to the mechanic whose hands and fingers may be trapped between heavy parts.

I have therefore provided a holder for use during overhaul reassembly that not only holds the push rods in place for proper interengagement but more importantly avoids the necessity of the mechanic jeopardizing his hands and fingers.

The holder is a unitary body 6 of a partially resilient material. This refers to a substance, usually a plastic, that can be readily molded into a desired permanent shape but that can be temporarily moved by manual force, at least in part, into a slightly different shape and will then return to its original shape when the manual force is removed.

Part of the body 6 is referred to as a head 7. That is a relatively thin, flat portion the opposite sides of which are disposed between or lie in two parallel planes. The head 7 has an outline and configuration for easy grasping. Extending from one edge of the head 7 is a plurality of pairs of fingers 8 and 9. These are somewhat thicker than the head although on one side they lie in the same plane as one face of the head. That side of the device is virtually flat. The relatively thick fingers 8 and 9 of each pair are longitudinally rather widely spaced from each other while each pair is slightly separated longitudinally from the adjacent pair.

The lower end 11 or tip of each finger is curved toward the adjacent finger of the pair and into close or actual abutment therewith. The lower end 11 of each finger is also shaped or curved into an arcuate configuration 12 in a transverse direction so that two adjacent lower end configurations define a substantial part of a circle. The arcuate surfaces are parallel to the length of the fingers. When seen end on, that circle is comparable in diameter to the diameter of the push rod with which those finger ends are to be used. The finger flexibility allows the arcuate configurations 12 and the entire lower ends 11 to adjust themselves to fit closely around rods of somewhat different diameters.

In a typical engine environment, valve push rods A and injector push rods B extend from a ball and socket abutment with cam shaft followers C in the engine crankcase, through a passage D in the engine block E to engage a ball and socket adjuster. This is at one end of a rocker arm F mounted to pivot within a removable cylinder head G and so to actuate a valve or injector. The injector location is usually between the inlet valve location and the exhaust valve location. Since operation of the injector requires a relatively large force, the injector push rod B, in the middle, is bigger than the valve push rods A. Also, the arcuate configurations 12 of the middle pair of fingers 8 and 9 is correspondingly larger than the end configurations of the end pairs of fingers 8 and 9.

In use, an overhaul includes the removal of a top valve cover H and the removal of the cylinder head G. This leaves the push rods A and B extending upwardly above the block E and in random directions since they are only supported by the ball and socket connections at the bottom.

Each group of three rods for one cylinder (two valve rods A and one injector rod B) is then transversely snapped by hand into and between the respective or corresponding pairs of fingers 8 and 9, the head 7 being manually held while this is accomplished. All of the engaged push rods are thus held in the same longitudinal plane and close to their proper operating locations as there is little room in the available engine spaces for substantial movement of the body 6.

When the engine head G is then lowered toward and onto the cylinder block E during assembly, the push rod ends and the mating rocker arm ends are readily and safely interengaged with the user's fingers and hands entirely out of the way. Little or no positional adjustment is usually necessary. But if some repositioning is needed, the user by holding safely on the body 6, especially on the head 7, can effect minor push rod positioning until the ball and socket parts are properly engaged.

Figure 7:
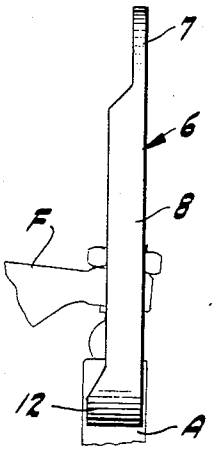
FIG. 7 is a diagram in side elevation of a holder of the invention in working position in the engine.
Figure 8:
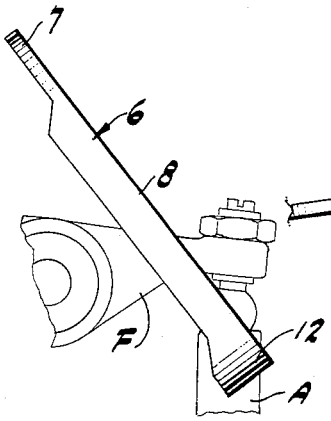
FIG. 8 is a diagram in side elevation of a holder of the invention is partially detached position in the engine; and, FIG. 9 is a diagram in side elevation of a holder of the invention in detached position relative to the engine.
Figure 9:
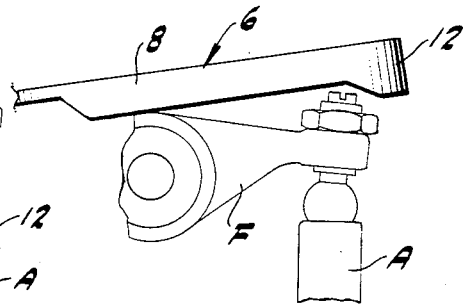

The tool or body 6 can then easily be removed, as seen in FIGS. 7, 8 and 9, by manually swinging the body 6 transversely against the adjacent ends of the rocker arms F. These then serve as fulcrums so that continued swinging movement spreads the arcuate ends of the fingers 8 and 9 apart as they cam over the push rods and finally snap free of the push rods. The tool is then simply lifted away for subsequent use.

During these operations, the user's hands and fingers are never in hazardous locations and the various push rods are disposed in proper locations for assembly.

What is claimed is:

1. In an alignment and supporting tool for simultaneously positioning a plurality of push rods in proper position for assembly in an internal combustion engine, the combination comprising: a body portion including a head portion displaced with respect to said body on one side of a vertical centerline of said body, a plurality of pairs of aligned finger portions extending downwardly from said head and substantially on the opposite side of said centerline, each finger of each of said pairs being integrally and resiliently secured to said body and configured to engage opposite sides of a common push rod and to apply a resilient retaining and aligning force thereto to position each of a plurality of said rods in a predetermined position with respect to each other, each finger in each pair of fingers being spaced from and generally configured to extend longitudinally along a portion of each rod and including terminal end portions having arcuate oppositely directed faces to embrace opposite arcuate surfaces of said push rod and retain said push rods in substantially parallel position during assembly of said engine while simultaneously aligning said rods with respect to each other and with respect to selected other engine components.

2. A device as in claim 1 in which said head has a predetermined thickness between bounding planes and said fingers are of more than said predetermined thickness and extend beyond one only of said planes.

3. A device as in claim 1 for use with a push rod of a predetermined diameter and in which said facing arcuate portions at rest are closer together than said predetermined diameter and can move apart resiliently to more than said predetermined diameter.

4. A device as in claim 1 for use with a rocker arm of a predetermined cross dimension and said fingers of said pairs are spaced apart more than said predetermined cross dimension.

* * * * *